US009347637B2

(12) United States Patent
Molinaro

(10) Patent No.: US 9,347,637 B2
(45) Date of Patent: May 24, 2016

(54) VEHICLE LAMP SOCKET ASSEMBLY

(71) Applicant: Federal-Mogul Corporation, Southfield, MI (US)

(72) Inventor: Mark C. Molinaro, Leo, IN (US)

(73) Assignee: Federal-Mogul Corporation, Southfield, MI (US)

( * ) Notice: Subject to any disclaimer, the term of this patent is extended or adjusted under 35 U.S.C. 154(b) by 181 days.

(21) Appl. No.: 13/843,570

(22) Filed: Mar. 15, 2013

(65) Prior Publication Data

US 2014/0273573 A1 Sep. 18, 2014

(51) Int. Cl.
*H01R 43/16* (2006.01)
*F21S 8/10* (2006.01)

(52) U.S. Cl.
CPC ..... *F21S 48/214* (2013.01); *F21S 48/212* (2013.01); *F21S 48/33* (2013.01); *Y10T 29/49204* (2015.01)

(58) Field of Classification Search
CPC .. F21V 19/0005; F21S 48/212; F21S 48/214; F21S 48/33; Y10T 29/49204; Y10T 29/49117; Y10T 29/49002
USPC ..... 29/874, 825, 592.1, 880, 878; 439/230, 439/206, 271, 519, 276, 699.2, 36; 362/645, 659, 267, 362
See application file for complete search history.

(56) References Cited

U.S. PATENT DOCUMENTS 7,736,165 B2 * 6/2010 Bukovnik ..... H01R 4/36 439/276
2005/0227541 A1 10/2005 Garcia et al.
2008/0113523 A1 * 5/2008 Owen ..... F21S 48/337 439/36
2012/0100737 A1 4/2012 Frey

FOREIGN PATENT DOCUMENTS

JP 2010105458 A 5/2010
KR 20070105998 A 10/2007

OTHER PUBLICATIONS

International Search report for application No. PCT/US2014/026272, dated Jul. 28, 2014, 3 pages.
Written Opinion for application No. PCT/US2014/026272, dated Jul. 28, 2014, 7 pages.

* cited by examiner

*Primary Examiner* — Peter DungBa Vo
*Assistant Examiner* — Azm Parvez
(74) *Attorney, Agent, or Firm* — Reising Ethington, P.C.

(57) ABSTRACT

A vehicle lamp socket assembly includes a housing, a body, a sealant, and a terminal blade. The housing has a cavity and has a connector with a socket. The housing also has a pass-through spanning between the cavity and the socket. In assembly, the body is received in the housing and has a retainer that holds a vehicle lamp. The sealant is located at the pass-through and fills a section or more of the pass-through. And the terminal blade extends through the pass-through and through the sealant.

9 Claims, 1 Drawing Sheet

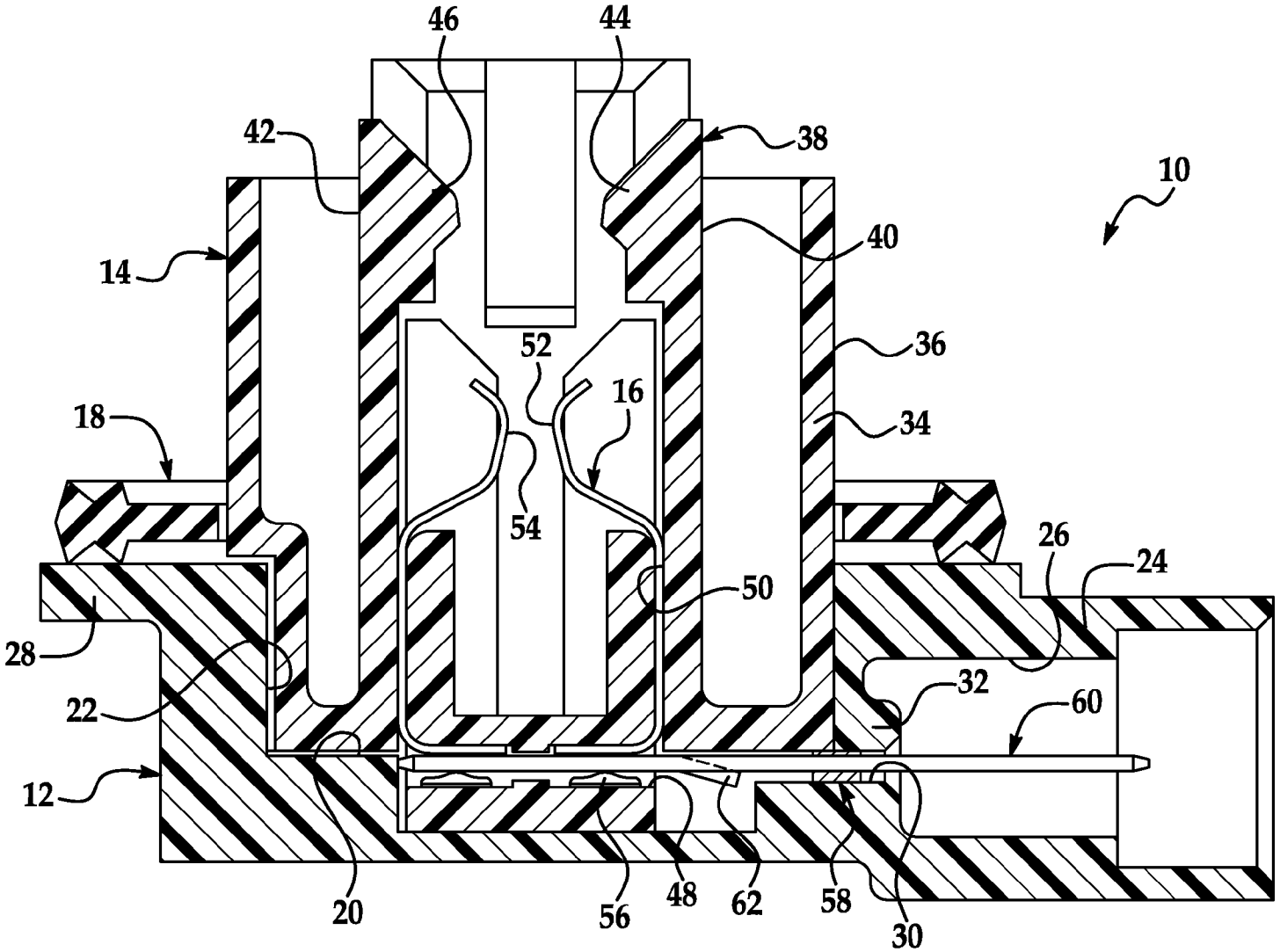
10
24
26
60
32
30
58
62
48
56
20
12
22
28
18
14
42
46
44
38
40
36
34
50
16
52
54

VEHICLE LAMP SOCKET ASSEMBLY

TECHNICAL FIELD

This disclosure generally relates to vehicle lighting and, in particular, to vehicle lamp socket assemblies used in exterior lighting applications.

BACKGROUND

Vehicles are equipped with exterior lighting to illuminate areas in front and in back of the vehicles at nighttime and during the day, to indicate left- and right-hand vehicle turns, as tail lights, and for other purposes. Lamp socket assemblies are sometimes provided as part of larger lighting assemblies, which often include a reflector and a lens as well. Typically, a lamp or bulb is snapped into a lamp socket assembly at one end, and a power supply is plugged into the lamp socket assembly at another end to deliver power to the lamp. These types of lamp socket assemblies are somewhat common in commercial and other automobiles, but can also be employed in marine and aerospace applications.

SUMMARY

According to one embodiment, there is provided a vehicle lamp socket assembly. The vehicle lamp socket assembly may include a housing, a body, a sealant, and a terminal blade. The housing has a cavity and a connector with a socket. The housing also has a pass-through that spans between, and communicates with, the cavity and the socket. The body is received in the housing and has one or more retainer(s) to hold a vehicle lamp in the body. The sealant is located at the pass-through and fills a section or more of the pass-through. And the terminal blade extends through the pass-through and through the sealant. The sealant is embedded around the terminal blade and provides a seal at the pass-through and at the terminal blade.

According to another embodiment, there is provided a method of assembling a vehicle lamp socket assembly. The method may include several steps, including sealing a pass-through in a housing. The pass-through spans between, and communicates with, a cavity of the housing and a socket of the housing. Another step includes inserting a body in the cavity. Yet another step includes passing a terminal blade through the pass-through. And another step includes piercing the sealing with the terminal blade and extending the terminal blade through the sealing.

According to another embodiment, there is provided a vehicle lamp socket assembly. The vehicle lamp socket assembly may include a housing, a body, an electrical contact, a grommet, a first sealant, a second sealant, a first terminal blade, and a second terminal blade. The housing has a cavity and a connector with a socket. The housing also has a first pass-through and a second pass-through. Each of the first and second pass-throughs span between, and communicate with, the cavity and the socket. The body is received in the housing and has one or more retainer(s) to hold a vehicle lamp in the body. The electrical contact is coupled with the body, and the grommet is located around the body. The first sealant is located at the first pass-through and fills a section or more of the first pass-through. The first sealant is further located between an inner surface of the housing and an outer surface of the body. The second sealant is located at the second pass-through and fills a section or more of the second pass-through. The second sealant is further located between the inner surface of the housing and the outer surface of the body. The first terminal blade extends through the first pass-through and through the first sealant. The first terminal blade abuts the electrical contact, and the first sealant is embedded around the first terminal blade and provides a first seal at the first pass-through and at the first terminal blade. The second terminal blade extends through the second pass-through and through the second sealant. The second terminal blade abuts the electrical contact, and the second sealant is embedded around the second terminal blade and provides a second seal at the second pass-through and at the second terminal blade.

BRIEF DESCRIPTION OF THE DRAWINGS

Preferred exemplary embodiments will hereinafter be described in conjunction with the appended drawing, wherein like designations denote like elements, and wherein:

The FIGURE is a sectional view of an embodiment of a vehicle lamp socket assembly.

DETAILED DESCRIPTION OF EXEMPLARY EMBODIMENTS

The vehicle lamp socket assembly set forth in this description provides a seal at its terminal blades against moisture, fluid, and other types of leakage that could potentially occur. Sealing of the terminal blades preclude leaking during tests before a larger lighting assembly is installed in a vehicle, and at other times after installation. The larger lighting assembly in which the vehicle lamp socket assembly is a component of typically also includes a lamp or bulb, a reflector, and a lens. The lighting assemblies can be employed in commercial automobiles like semi-trailer trucks and busses, non-commercial automobiles like cars and sport-utility-vehicles, marine applications, and aerospace applications. In these installations and others, the lighting assembly can be used as a headlamp, a turn signal, a brake light, or as another exterior light. And while illustrated by one embodiment in the FIGURE, the vehicle lamp socket assembly can have different designs and constructions than that shown, some of which are described below.

Referring to the FIGURE, in this embodiment a vehicle lamp socket assembly 10 (hereafter, socket assembly 10) is a multi-piece component that includes a housing 12, a body 14, an electrical contact 16, a grommet 18, one or more sealant(s), and one or more terminal blade(s). Customarily, though not always the case, the housing 12 and body 14 are made of a suitable plastic material, the grommet 18 is made of a suitable rubber material, and the electrical contact 16 and terminal blade(s) are made of a suitable metal material.

The housing 12 has a cavity 20 that receives insertion of the body 14. The cavity 20 can be cylindrical in shape and is defined in part by an inner surface 22 which directly confronts the body 14 in assembly. For plugging with a power supply, the housing 12 has a connector 24 with an internal socket 26. Although depicted in side view, the connector 24 and socket 26 commonly have an oblong shape when viewed in a front, head-on direction. In this embodiment, the socket 26 serves as a female part when mated with a complementary power supply plug, but in other embodiments could serve as a male part. Furthermore, a flange 28 projects around a perimeter of the cavity 20, and assists seating the grommet 18. For receiving insertion of a terminal blade, a pass-through 30 spans between the cavity 20 and the socket 26. The pass-through 30 is open to the cavity 20 on one side and to the socket 26 on its other side, and can have a cylindrical cross-sectional profile. The pass-through 30 is defined in a rear wall 32 of the connector 24, and communicates with the cavity 20 at a lower section of the cavity where the inserted terminal blade can access the electrical contact 16.

The body 14 is inserted into the housing's cavity 20 and accepts a lamp's base that can be snapped into it. An outer wall 34 of the body 14 is placed in the cavity 20, and an outer surface 36 thereof directly confronts the inner surface 22. To permanently attach the housing 12 and body 14 once brought together, they can be bonded via ultra sonic welding or via another technique. The lamp's base is snapped into the body 14 by way of a retainer 38 which can take different forms. In the FIGURE, the retainer 38 includes a pair of flexible fingers 40, 42 with nubs 44, 46 projecting inwardly from the fingers in order to make a mechanical interlock with a complementary base structure of the lamp. And to accommodate abutment between the electrical contact 16 and the terminal blade (s), various openings and passages can be provided in the body 14. For example, the terminal blade(s) are inserted into a bottom passage 48 where they can abut the electrical contact 16, which also is routed through the bottom passage and is inserted upward from the passage through an opening 50.

The electrical contact 16 is coupled with the body 14 and pinches sides of the lamp's base when the lamp is snapped into the body. Upper prongs 52, 54 of the electrical contact 16 stretch out into an interior of the body 14 inboard of the fingers 40, 42 for direct pinching the lamp's base, and a lower end 56 is wrapped around a bottom of the body 14.

The grommet 18 facilitates installation of the socket assembly 10 within the larger lighting assembly, and can provide a seal against a wall of the lighting assembly. The grommet 18 can have a somewhat annular shape and is placed around the outside of the body 14 and is seated against the top of the housing's flange 28. In other embodiments, the grommet 18 need not necessarily be provided as part of the socket assembly 10.

The sealant(s) provide a seal against leakage between the cavity 20 and the socket 26, and around the terminal blade (s)—particularly, the sealant(s) can be provided at any pass-throughs or communications between the cavity and socket. In the FIGURE, the sealant(s) include a sealant 58 located adjacent and at the pass-through 30. A portion of the sealant 58 can be inserted into the pass-through 30, while another portion of the sealant can remain outside of the pass-through but around its open end. The portion filled in the pass-through 30 provides a seal thereat. Still, the sealant 58 outside of the pass-through 30, if present, can touch the housing's inner surface 22 and the body's outer surface 36 and hence form seals with the surfaces. Moreover, the sealant 58 embeds and fully surrounds an axial portion of the terminal blade(s) and forms a seal circumferentially around that portion of the terminal blade(s).

Furthermore, the socket assembly 10 can include more regions of sealant that are not depicted in the FIGURE because the FIGURE only illustrates a single cross-section of the socket assembly 10. For example, the socket assembly 10 could include a second pass-through spanning between the cavity 20 and the socket 26 for receiving insertion of a terminal blade. A second sealant would then be provided at the second pass-through to preclude leakage thereat between the cavity 20 and socket 26. And like the sealant 58, a portion of the second sealant could be inserted into the second pass-through, while another portion of the second sealant could remain outside of the second pass-through but around its open end. The portion filled in the second pass-through would provide a seal thereat. Also, the second sealant outside of the second pass-through, if present, could touch the housing's inner surface 22 and the body's outer surface 36 and hence form seals with the surfaces. Moreover, the second sealant would embed and fully surround an axial portion of the inserted terminal blade and would form a seal circumferentially around that portion of the terminal blade. This second sealant would typically be the same material as the first sealant, but could be different. Alternatively, a single mass of sealant could be supplied that spans both pass-throughs.

However many sealants are provided in the socket assembly 10, the sealants can be composed of a material that maintains suitable sealing performance around the terminal(s) when the socket assembly 10 is put together. For instance, the sealants can be composed of a material that initially is applied as a viscous material and subsequently hardens in place to provide a suitable sealing functionality—in this sense, the sealants can be a caulking material. The sealants can also be composed of a material having self-healing capabilities so that, when the sealants are pierced by the terminal blade(s) as described below, they restore themselves around the piercing and fully enclose the terminal blade(s) to ensure sealing thereat. Various materials may exhibit suitable viscosity, self-healing, or both in the ways described. Still, the sealants need not necessarily be composed of a material that exhibits the described viscosity and self-healing. Specific examples include a silicone-based sealant and a silicone-based adhesive material; other examples may exist.

The terminal blade(s) plug into the power supply at one end and abut the electrical contact 16 at another portion of their extent. In the FIGURE, the terminal blade(s) include a terminal blade 60. Between the power supply and electrical contact 16, the terminal blade 60 passes through the pass-through 30 and extends through the sealant 58. One or more barb(s) 62 can project outwardly of the terminal blade's body to prevent its inadvertent removal through the pass-through 30. In other embodiments, the terminal blade(s) can be provided with attached and crimped wires extending from them. And as before, because the FIGURE only illustrates a single cross-section of the socket assembly 10, a second terminal blade could be provided as part of the socket assembly.

The socket assembly 10 can be assembled together in different ways. In a first example procedure, the sealant 58 is applied at the pass-through 30 and at other desired sites while the housing 12 and the body 14 remain apart from each other. This may more readily furnish the access needed for application of the sealant 58 at the inner surface 22 and at the pass-through 30. The housing 12 and body 14 can then be brought together, and an ultra sonic welding step can be undertaken to attach the housing and body. Before ultra sonic welding, the sealant 58 can be allowed to harden in place. Thereafter, the terminal blade 60 can be inserted through the pass-through 30 and through the hardened sealant 58. As it approaches the sealant 58, the terminal blade's pointed free end pierces through the sealant and the blade continues its insertion through the pass-through 30 and through the sealant. If the sealant 58 is composed of a material with self-healing capabilities, the sealant restores itself around the terminal blade 60 and fully encloses the terminal blade for a seal therearound.

In a second example procedure, the sealant 58 is applied at the pass-through 30 after the housing 12 and body 14 are brought together, and possibly after ultra sonic welding is undertaken. In this case, the sealant 58 can be applied by way of the socket 26. For instance, the sealant 58 can be applied in the pass-through 30 at an open end of the pass-through communicating with the socket 26 and on the socket-side thereof. Here, the terminal blade 60 may already be extended through the pass-through 30, and the sealant 58 can be applied around the terminal blade. This can take place before or after the housing 12 and body 14 are attached together by ultra sonic welding. Still, in an alternative to the second example procedure, the sealant 58 can be applied before insertion of the terminal blade 60, in which case the sealant may be composed of a self-healing material. Other assembly procedures exist and may be dictated by the type of sealant being applied and the attachment made between the housing and body.

By using a self-healing sealant material and having the pass-throughs sealed before insertion of the terminal blades, this assembly method permits the blades to be inserted after the remainder of the socket assembly 10 is produced. This allows for a direct-wire installation of the terminal blades while permitting the blades to be sully sealed to the housing.

In another embodiment not illustrated in the FIGURE, the vehicle lamp socket assembly could be designed and constructed in an axial configuration instead of the L-shaped configuration shown. In an axial configuration, the body and connector would have their respective lengthwise extents in-line with each other, as opposed to orthogonally relative to each other as shown in the FIGURE.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of assembling a vehicle lamp socket assembly, the method comprising the steps of:

sealing a pass-through in a housing, said pass-through spanning between a cavity of said housing and a socket of said housing;

inserting a body in said cavity;

passing a terminal blade through said pass-through; and piercing said sealing with said terminal blade and extending said terminal blade through said sealing wherein the step of inserting said body in said cavity is performed before said sealing hardens.

2. A method as defined in claim 1, further comprising the step of welding said body and said housing together.

3. A method as defined in claim 2, wherein the step of welding said body and said housing together is performed after the step of sealing said pass-through.

4. A method as defined in claim 1, further comprising the step of placing a grommet around said body.

5. A method as defined in claim 1, further comprising the step of coupling an electrical contact to said body.

6. A method as defined in claim 1, wherein said sealing is a silicone sealing.

7. A method as defined in claim 1, wherein said sealing is a self-healing sealing.

8. A method as defined in claim 1, wherein the step of piercing said sealing with said terminal blade is performed after said sealing hardens.

9. A method as defined in claim 1, further comprising the steps of:

sealing a second pass-through in said housing, said second pass-through spanning between said cavity of said housing and said socket of said housing;

passing a second terminal blade through said second pass-through; and piercing said sealing of said second pass-through with said second terminal blade and extending said second terminal blade through said sealing of said second pass-through.

* * * * *